United States Patent [19]

Fischer

[11] Patent Number: 4,487,408

[45] Date of Patent: Dec. 11, 1984

[54] UNIT FOR PARALLELIZING SHEET-LIKE PRODUCTS AT THE DELIVERY END OF A PRINTING PRESS

[75] Inventor: Rudolf Fischer, Ludwigshafen-Oggersheim, Fed. Rep. of Germany

[73] Assignee: Albert-Frankenthal AG, Frankenthal, Fed. Rep. of Germany

[21] Appl. No.: 380,214

[22] Filed: May 20, 1982

[30] Foreign Application Priority Data

Jun. 12, 1981 [DE] Fed. Rep. of Germany ..... 3123406

[51] Int. Cl.[3] ..... B65H 9/10

[52] U.S. Cl. ..... 271/233; 271/187; 271/202; 271/271; 271/315

[58] Field of Search ..... 271/307, 187, 315, 233, 271/202, 203, 271

[56] References Cited

U.S. PATENT DOCUMENTS

| | | | |
|---|---|---|---|
| 1,956,541 | 4/1934 | Spillane | 271/315 X |
| 3,390,508 | 7/1968 | Heimlicher | 271/315 X |
| 3,671,035 | 6/1972 | Reist | 271/202 |
| 3,964,598 | 6/1976 | Alsop | 271/315 X |
| 4,205,837 | 6/1980 | Von Hein | 271/315 X |

*Primary Examiner*—Richard A. Schacher

*Attorney, Agent, or Firm*—Collard, Roe & Galgano

[57] ABSTRACT

In connection with a unit for parallelizing a chain of overlapping printed products such as signatures (that is to say causing the leading edges to be parallel), delivered by way of a fan wheel onto a delivery belt thereunder, the purpose of the invention is to make for trouble-free operation, to see that the signatures are completely regularly placed, and to make upkeep work on the unit simple. For this purpose, the unit has at least one driver which is moved along at a higher speed than the signatures so as to come up against the trailing edge of each signature as its leading edge comes onto the delivery belt. The driver is moved along a line of motion in such a way that at least part of such motion is directed out of the transport plane of the delivery belt. The driver may be a simple kicking edge of a part fixed to a driver support.

7 Claims, 1 Drawing Figure

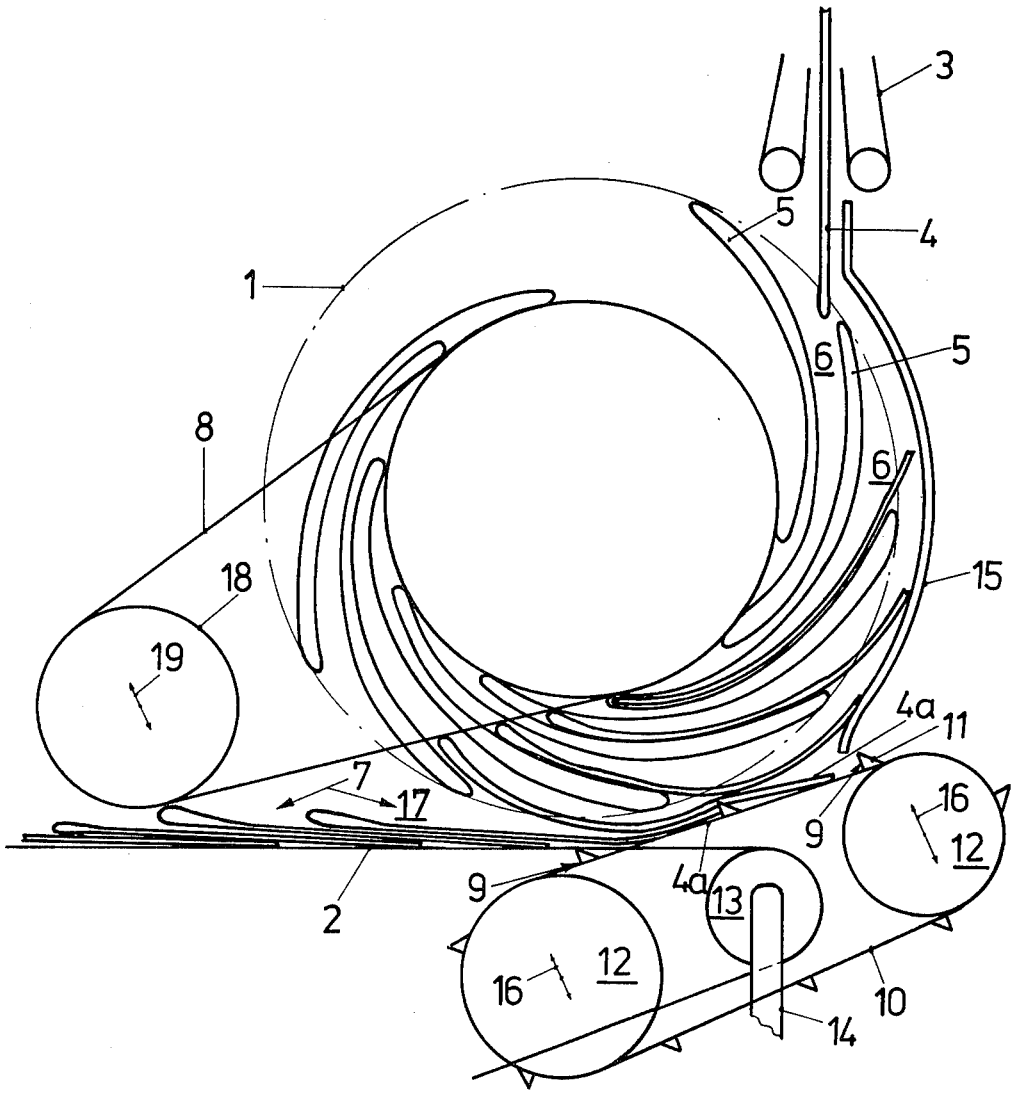
3
5
4
1
6
5
8
6
18
15
19
4a
11
7
17
16
9
12
9
4a
13
2
16
12
10
14

UNIT FOR PARALLELIZING SHEET-LIKE PRODUCTS AT THE DELIVERY END OF A PRINTING PRESS

BACKGROUND OF THE INVENTION

The present invention is with respect to a unit for parallelizing a chain of overlapping sheet-like products, such as signature (that is to say causing their leading edges to be parallel), coming from a fan wheel and running on a delivery belt under the fan wheel.

A known system on these lines makes use of a number of parallel gripper chains running into spaces between different axial parts of the fan wheel, the grippers on the chains taking up the signatures in the spaces of the fan wheel at the leading edge of each such signature. The gripper chains are run at a speed which is less than the effective peripheral speed of the fan wheel so that the signatures gripped by the grippers are lifted out of the spaces in the fan wheel and put onto the delivery belt thereunder. Although with an apparatus on these lines it is possible to get an even spacing between the signatures which are overlapped on top of each other on the delivery belt, the known apparatus is not only heavy on upkeep, but is furthermore very likely to get out of order because the grippers and the chains used therefor are very easily damaged. Moreover, the gripper chains running between the two parts or disks of the fan wheel make it necessary for such disks to be spaced at some distance from each other, an undesired effect in this respect being that the signatures, taken up in the spaces in the fan wheel, are without any support in the openings kept free for the gripper chains, for this reason, may be whipped outwards by centrifugal forces so that it is not only harder to make certain that the signatures are gripped by the grippers on the chains, but furthermore the signatures may not be regularly placed. In short, the known apparatus is not simple and trouble-free enough.

GENERAL OUTLINE OF THE INVENTION

Taking such prior art as a starting point, one purpose of the present invention is that of overcoming the undesired effects of such prior art and designing a unit of the sort noted which is not only simple, but furthermore makes upkeep work simple, and even when run under rough conditions makes certain of trouble-free operation and, at the same time, a completely regular positioning of the signatures or other sheet-like products.

This purpose, and further purposes, may be effected in a surprisingly simple way by the use of a driver which is moved at a speed higher than transport speed of the products and comes up against the trailing edge of each last product as the leading edge of the same is on the delivery belt, such driver being moved along a line which at least in part comes out of the transport plane of the delivery belt.

For forming the driver, it is possible to make use, quite simply, of a kicker edge of a part fixed to the support used therefor, such kicker edges not having any moving parts needing a controlling system (like a gripper) so that trouble-free operation is made certain of. For clearing the driver from the trailing edge of the signature or other product in question, the driver may be moved along a line coming out of the transport plane of the signatures in a downward direction, this giving a simple, self-controlling effect. The unit of the present invention, which, as a useful effect, may be run for long stretches of time without any upkeep work being necessary thereon, will be seen, for this reason, to be specially simple and straightforward. The products placed on the delivery belt may be parallelized and lined up from their trailing edges, the drivers not coming up against the fan wheel. In this respect, it is possible, as a further useful effect, for the signatures to be supported at the fan wheel over a generally large breadth, this cutting out any chance of damage to the signatures, of the system getting out of order, or of the signatures being irregularly placed. The useful effects produced by the present invention are, for this reason, to be seen more specially in very trouble-free operation while nevertheless using a simple design structure. The outcome of this is that the unit is very economic.

As part of a further useful development of the invention, the driver or drivers may take the form of a dog support which is moved at an unchanging speed and is more specially formed by a belt running over guide-wheels. Such a design makes possible a simple driving system for the drivers. The use of a belt with dogs gives a useful effect inasfar as driving takes place along a long, generally speaking, straight dog path so that the signatures are made parallel without any trouble conditions being produced. A useful effect may be produced in this respect if two or more parallel dog supports are used, whose dogs are lined up with each other in a direction normal to the direction of motion. Such a design makes it possible, as a further useful effect, for the parallelizing forces acting on the product or signatures to take effect at different points, which are, generally speaking, widely spaced, this making certain of trouble-free parallelizing of the signatures.

As part of a further useful development of the invention, the delivery belt may be made up of a number of separate, spaced single belts, between which the driver or drivers is (or are) interleavingly run. In this respect, the drivers are only cleared from the separate trailing edges of the signatures when the complete signature has been placed on a delivery belt, this making certain of completely regular placing of the signatures.

The belts forming the dog support and, more specially, interleaved between the separate belts of the delivery belt may best be placed so that they are at a slope, such slope running upwards in a direction opposite to the direction of transport. Such a design is well-matched to the outer periphery of the fan wheel and makes certain that the trailing edges of the signatures are taken up by the belts, designed as dog supports, near the fan wheel so that trouble conditions are unlikely.

As part of a further useful development of the invention, the dog or dogs may be able to be changed in their timing so that they may be made to take effect on the trailing edges of the signatures at quite the desired point in time and the signatures are completely parallelized.

As part of a still further development of the invention there is at least one clearing belt interleaved with parts of the fan wheel and placed over the delivery belt, such clearing belt being run at the same speed as the delivery belt and walling in together with the same a space which becomes narrower in the direction of transport to a narrowest point, which is spaced from the cross-over point between the line of motion of the drivers and the plane of transport of the delivery belt by a distance generally equal to the length of a signature in the direction of transport, that is to say equal to the format length. This makes certain that the drivers come clear of the trailing edges of the signatures once each signature's leading edge has come into the narrowest end of the space between the delivery belt and the clearing belt and, for this reason, is grippingly guided and transported at its leading edge.

Further useful developments of the invention will be seen from the account now to be given of one working example using the single FIGURE, and from the claims.

DETAILED ACCOUNT OF WORKING EXAMPLE OF THE INVENTION

The single FIGURE is a diagrammatic side view of a fan wheel delivery apparatus having a unit for evenly placing products delivered by the apparatus by way of belts with dogs.

The delivery apparatus to be seen in the FIGURE and which may be placed, for example, after the folder of a printing press, has a fan wheel 1 placed over a delivery belt 2 for delivery of printed products, as for example signatures to a further processing station as for example a parcel unit or the like. The fan wheel 1 takes up the folded signatures 4 from a belt system 3 coming to an end over the fan wheel. The signatures 4, freed by the belt 3, are whipped downwards into the spaces 6 formed between the blades 5 of the fan wheel 1 and after one quarter of a turn of the fan wheel are put out in the form of a chain 7 of overlapped signatures, like scales, on delivery belt 2. For clearing the signatures 4 from the spaces 6 of the fan wheel, there are a number of parallel clearing belts 8 running inbetween the axially spaced disk-like parts of the fan wheel 1, that is to say with the belts 8 interleaved between such fan wheel parts. The clearing belts 8 are generally narrow so that the distance between the disk-like parts (forming the fan wheel) may be small.

In the case of a prior art fan wheel delivery apparatus, the signatures 4 are dropped uncontrolledly out of the spaces 6 of the fan wheel onto the delivery belt thereunder. In this case it is not possible to get a completely regular spacing between the edge of any one overlapped signature and the edge of the next one thereto. On the other hand, when the press speed is increased, there is a greater need for a completely regular placing of such signatures, because otherwise the chain of signatures may not be taken up by carefully timed grippers of the next unit for processing the signatures, as for example a parcel delivery unit.

The signatures 4 coming onto the delivery belt 2 are, for this reason, acted upon in each case at their trailing edge by drivers 9, which are moved at a forward speed higher than the normal transport speed of the signatures 4 as dependent on the delivery belt 2, such drivers producing an orderly chain of signatures, in which the signatures are completely parallel to each other and have a completely even spacing between them. The drivers 9 are placed on an endless driver support 10 turned at an equal speed by which the trailing edges of the signatures coming up against the drivers 9 are taken up and supported after the fan wheel 1 has let go of them. The line of motion of the drivers 9 is placed so as to be crossing over the transport plane of the delivery belt 2 in a downward direction so that the drivers 9 at a certain point go under the transport plane of the delivery belt 2 and so automatically come clear of the signatures' trailing edges such as 4*a*. The drivers 9 are, in this respect, so timed that they only come up against the trailing edge of the signature in question when its leading edge has come clear of the fan wheel 1.

To make certain that the signature is fully controlled in a desired way when acted upon by a driver 9, such driver is made up of two or more spaced dogs 11 whose driving edges are in line with each other and are on separate dog supports which are spaced and placed side by side. In the working example in question, the supports 10 having the drivers 9 take the form of belts running over driving and guidewheels 12, such belts having equally spaced dogs 11 on their outer faces, this producing a long straight line of motion of the dogs. To make certain that the signatures 4 are taken up in a trouble-free way by the delivery belt 2, its parts are interleaved (or interfaced) at the leading end of, and with the belts forming the driver supports 10. To this end, the delivery belt 2 is made up of a number of spaced single belts running over guidewheels 13 so as to be interleaved with the belts at their front end in the transport direction, such belts functioning as driver supports 10. The guidewheels 13 which are to the back in the transport direction, of the single belts forming the delivery belt 2 are bearinged on rocking levers 14 which may be rocked for adjustment of the pull on the belts.

The belts functioning as the driver supports 10 are placed at such a slope in relation to the delivery belt that their top run will be seen to become higher than the delivery belt 2 in a direction opposite to the direction of belt transport, this making certain that the signature ends 4*a* coming onto the belts forming the driver supports 10 may be taken up at a point near the fan wheel and there is no danger of a free fall. The outer part of the fan wheel 1 which is in the process of moving downwardly towards the slopingly placed belts forming the driver supports 10 is covered over by a sheet metal guide 15, whose lower end is overlapped past the guidewheels 12 (which are to the back in the transport direction) of the driver supports 10 and, for this reason, generally speaking, the upwardly running part of the line along which the drivers are moved, so that the signature ends, slipping downwards on this sheet metal guide 15, are squarely taken up by the driver supports 10 and squarely and regularly taken up by the drivers 9. The placing of the driver support 10 and the delivery belt 2 is such that the top one of the belts, forming the driver support 10, will be seen to be crossing over a delivery belt 2, that is to say the separate belts thereof, in a straight part of such belt, this making certain that the drivers 9, on coming out of the transport plane of the delivery belt 2 are smoothly, that is to say not violently, moved clear of the trailing edge of a signature at this point. The slope of the belts acting as the driver supports 10, may be changed so that the position of change of the drivers 9 out of the transport plane of the delivery belt 2 may undergo adjustment. For effecting this purpose all that is needed is for the belts, functioning as the driver supports 10, to have their support and guidewheels 12 rockingly supported so that they may be moved as marked by the double-headed arrow 16. In this connection it is best for the front and back guidewheels to be able to be moved generally about an axis in the middle of the belt so that the positioning of the belts, functioning as the driver supports 10, so as to be tangential with relation to the fan wheel 1 is kept to.

For making certain of trouble-free operation, the drivers 9 may be changed in their timing in relation to the signatures. For this purpose, in the present working example, the belts, functioning as the driver supports 10, are simply designed so that they may be moved or timed backwards and forwards, for example by having helical gears for driving the wheels 12 so that when such wheels are moved along their axes in relation to each other, the timing is changed. Furthermore, it would be possible for one gear in such driving gearing to be joined with its shaft by way of helical splines so that on moving the gear axially, the timing would be changed. Such a system would give a specially large timing range.

The clearing belts 8 interleaved with the different parts of the fan wheel 1 are so placed that their lower run placed over the delivery belt 2 makes with such delivery belt a space 17 which becomes narrower in the transport direction so that the signatures resting on the delivery belt 2 are acted upon by the clearing belts 8 at the narrowest end of this space and are forced by such belts 8 against the delivery belt 2, that is to say the separate belts thereof. The belts 2, functioning here as the driver supports 10, are, in this case, placed at such an angle that the line of motion of the drivers 9 is so crossed over the plane of transport of the delivery belt 2 that the drivers 9 are moved clear of the trailing edges of the signatures at that point in time at which the trailing edge of each such signature is taken up and gripped at the front narrow end of the narrowing space 17 by the clearing belts 8 so that the signatures are not acted upon by two forces at the same time. It is best for the narrowest end of space 17 to be able to undergo adjustment to be matching the thickness of the signatures. To this end, the guidewheels 18, placed at the narrowest end of space 17, may be moved bodily about the axis of fan wheel 1, this being marked by double-headed arrow 19.

It is to be noted that although an account has been given of a preferred working example of the invention in detail, such account is not to be taken to have the effect of limiting the ideas on which the invention is based and in fact those trained in the art will know of a number of different ways in which the general teaching of the invention may be changed to be in line with the needs of a special case. To take an example, the driver supports might be in the form of wheels placed side by side and, more specially, interleaved with the delivery belt 2.

I claim:

1. In a delivery unit designed for parallelizing leading edges of overlapped sheet-like products, moving in a line, having a fan wheel and a delivery belt positioned thereunder for taking up said products from said fan wheel as a chain of said products overlapped like scales in said parallelizing operation, the improvement comprising:

a driving system including a plurality of parallel endless driver belts running at constant speed each having a plurality of drivers equally spaced on the outer side thereof, said drivers being in the form of dogs;

said driving system moving said drivers at a higher speed than the trailing edge of each product last to have a leading edge thereof placed on said driving belt; and the driver belts of said driving system being placed so as to have an upwardly running slope, in a direction opposite to the direction of transport in relation to the delivery belt, so that where said drivers come up against said sheet-like products they move along a sloping line of motion in respect to the plane of transport of said delivery belt.

2. A delivery unit as claimed in claim 1, wherein said delivery belt is made up of a number of spaced separate belts interleaved with said drivers.

3. A delivery unit as claimed in claim 1, wherein the timing of said driver in relation to said fan wheel may be changed.

4. A delivery unit as claimed in claim 1, having a clearing belt placed over the delivery belt and taken up in a space between two parts of said fan wheel for moving said products out of said fan wheel, said clearing belt being designed to be run at the same speed as said delivery belt and walling in together with said delivery belt a space which becomes narrower in the direction of transport, the narrowest part of said space being at a distance from the crossing point of the planes of said driver support belts and said delivery belt generally equal to the length of one product in the direction of transport.

5. A delivery unit as claimed in claim 4 having a system for making possible adjustment of the position of a guide part of said clearing belt in relation to said delivery belt.

6. A delivery unit as claimed in claim 1 having a system for adjustment of the slope of a top run of the driver belt.

7. A delivery unit as claimed in claim 1 having a sheet metal guide placed round a side of said fan wheel where said fan wheel is moved towards said delivery belt, said sheet metal guide having a lower end overlapping an end of the one side of an endless path of motion of said driver.

* * * * *